United States Patent [19]

Dethlefsen

[11] 4,130,781

[45] Dec. 19, 1978

[54] HIGH VOLTAGE D-C VACUUM INTERRUPTER DEVICE WITH MAGNETIC CONTROL OF INTERRUPTER IMPEDANCE WITH MOVABLE CONTACT

[75] Inventor: Rolf Dethlefsen, Greensburg, Pa.

[73] Assignee: Gould Inc., Rolling Meadows, Ill.

[21] Appl. No.: 777,453

[22] Filed: Mar. 14, 1977

[51] Int. Cl.[2] ..... H01J 1/50; H01H 9/44

[52] U.S. Cl. ..... 315/331; 200/144 B; 313/146; 313/162; 315/338; 315/340; 315/344; 315/357

[58] Field of Search ..... 315/331, 332, 338, 340, 315/344, 357; 200/147 R, 144 B; 313/146, 152, 160, 162

[56] References Cited

U.S. PATENT DOCUMENTS 3,696,264 10/1972 Clark et al. ..... 313/162 X

*Primary Examiner*—Alfred E. Smith

*Assistant Examiner*—Charles F. Roberts

*Attorney, Agent, or Firm*—Ostrolenk, Faber, Gerb & Soffen

[57] ABSTRACT

A circuit interrupter which can be used as a high voltage d-c breaker or fault current limiter transfer switch or the like contains a pair of cooperable contacts disposed in an evacuated container. One of the contacts also serves as the cathode of a magnetically modulated vacuum arc discharge device. This cathode is spaced from an anode disposed in the wall of the evacuated housing. The anode is surrounded by a winding which is capable of producing a magnetic field which can increase the impedance of the arc plasma between the cathode and anode in order to decrease the arc current and extinguish the arc. The cooperable contacts within the interrupter serve to carry load current and also serve to create the inital arc which is transferred between the anode and cathode structures.

9 Claims, 3 Drawing Figures

HIGH VOLTAGE D-C VACUUM INTERRUPTER DEVICE WITH MAGNETIC CONTROL OF INTERRUPTER IMPEDANCE WITH MOVABLE CONTACT

RELATED APPLICATIONS

This application is related to copending application Ser. No. 777,479, filed Mar. 14, 1977, in the name of Rolf Dethlefsen, entitled HIGH VOLTAGE D-C VACUUM INTERRUPTER DEVICE WITH MAGNETIC CONTROL OF INTERRUPTER IMPEDANCE, and assigned to the assignee of the present invention.

BACKGROUND OF THE INVENTION

This invention relates to circuit interruption devices, and more specifically relates to a novel combined vacuum switch and magnetically modulated vacuum arc discharge device, wherein the vacuum switch serves as the means for carrying load current and/or forming the initial arc which is transferred between anode and cathode elements of the magnetically modulated vacuum arc discharge device.

The interrupter of the invention is applicable as a high voltage d-c circuit breaker arranged as a transfer switching element for a fault current limiter to be used in an a-c utility network.

Magnetically modulated vacuum arc discharge devices are known and are described in the above copending application Ser. No. 777,479 and are also described in a paper by Gilmour and Lockwood, entitled THE INTERRUPTION OF VACUUM ARCS AT HIGH DC VOLTAGES, which is published in IEEE Transactions on Electron Devices, Volume ED-22, No. 4, April 1975, pages 173 to 180. Such devices are also described in U.S. Pat. No. 3,696,264 in the name of Clark et al. In such devices, a cathode is disposed along the axis of an anode ring and an arc discharge created between the anode and cathode can be controlled and extinguished by a magnetic field which is produced through the arc as by a winding surrounding the anode ring. In order to initiate this arc, an auxiliary electrode has been positioned adjacent the cathode electrode and an initial arc is drawn between the auxiliary electrode and the cathode. This arc is subsequently transferred to between the cathode and anode.

When a device of this type is used as a fault current limiter transfer switch or the like, an additional switching device must be provided which is able to carry load and fault current in parallel with the magnetically modulated vacuum arc discharge structure. This additional switching device increases the cost and complexity of the total assembly. Moreover, the parallel switching device must be of such a nature that it can generate sufficient arc voltage after opening under a fault current that the parallel vacuum arc device will be triggered. Current will then commutate from the switching device to the vacuum arc, and the vacuum arc device will carry the fault current at low arc voltage until the magnetic modulation forces a rise in arc voltage sufficient to extinguish the arc current. The parallel load current carrying switch must also be designed so that the mechanical contacts will not arc over when the arc voltage of the vacuum arc device increases and the arc is extinguished.

BRIEF DESCRIPTION OF THE PRESENT INVENTION

In accordance with the present invention, the vacuum container which carries the magnetically modulated vacuum arc discharge assembly also contains the parallel vacuum switching device. Thus, the auxiliary parallel switching device is incorporated into the same vacuum container as the magnetically modulated device and the vacuum switching device will have the inherent fast-acting characteristic of a vacuum interrupter where a relatively small contact gap of up to 2 centimeters in length can insulate against high voltages.

In carrying out the invention, it is possible to have the anode and cathode electrodes constructed in such a manner that they also serve as the cooperable contacts of the vacuum switching device, but this places many restrictions on the geometry and possibly magnetic field configuration needed to attain magnetic modulation and high voltage d-c switching. Thus, in accordance with the preferred embodiment of the present invention, the anode and cathode elements are stationarily mounted relative to one another, and a movable contact is disposed within the container and cooperates with the cathode electrode which serves as the second contact of the vacuum switch device.

The movable contact then serves as a contact of the vacuum switching device and also serves to initiate the arc between the anode and cathode by drawing an arc to the cathode when the movable contact is moved to its open position. This initial arc consists of a relatively dense arc plasma near an orifice through the cathode so that sufficient charge carriers can pass through this orifice and then trigger the magnetically modulatable gap between the cathode and anode.

It should be noted that the discharge in the anode-to-cathode gap is initially of a low density and starts with a low arc voltage. Once the switch gap between the movable contact and cathode has opened sufficiently and has recovered (arcing between the movable contact and cathode is extinguished), it is now possible to magnetically modulate the arc between the cathode and anode in order to increase the arc voltage and extinguish the arc. When the arc voltage is increased, the gap between the movable contact and cathode has recovered sufficiently that the arc voltage between the cathode and anode will not cause reignition of the arc from the movable contact.

A high arc voltage is initially desired in the arc gap between the movable contact and the cathode. This high arc voltage is desirable to ensure transfer of current to the anode-to-cathode gap. This high arc voltage in the mechanically moving arc gap can be attained by suitable choice of materials and geometry of the components of the moving contact arc gap. If desired, an additional series arcing gap disposed in hydrogen, air or oil can be arranged external to the evacuated housing envelope and in series with the moving contact. This contact may then open after the moving contact has started to interrupt the arc to the cathode to increase the initial arc voltage.

Suitable insulation and metallic shields may also be provided within the envelope for proper control of the arc attachment. It may also be desired to provide a transverse magnetic field across the orifice through the cathode (which permits the flow of high density charge carriers from the moving arc gap and into the magnetically controllable arc gap) in order to force low density charge carriers passing through the passage to strike the walls of the orifice and recombine before traversing the orifice.

DETAILED DESCRIPTION OF THE DRAWINGS

Figure 1:
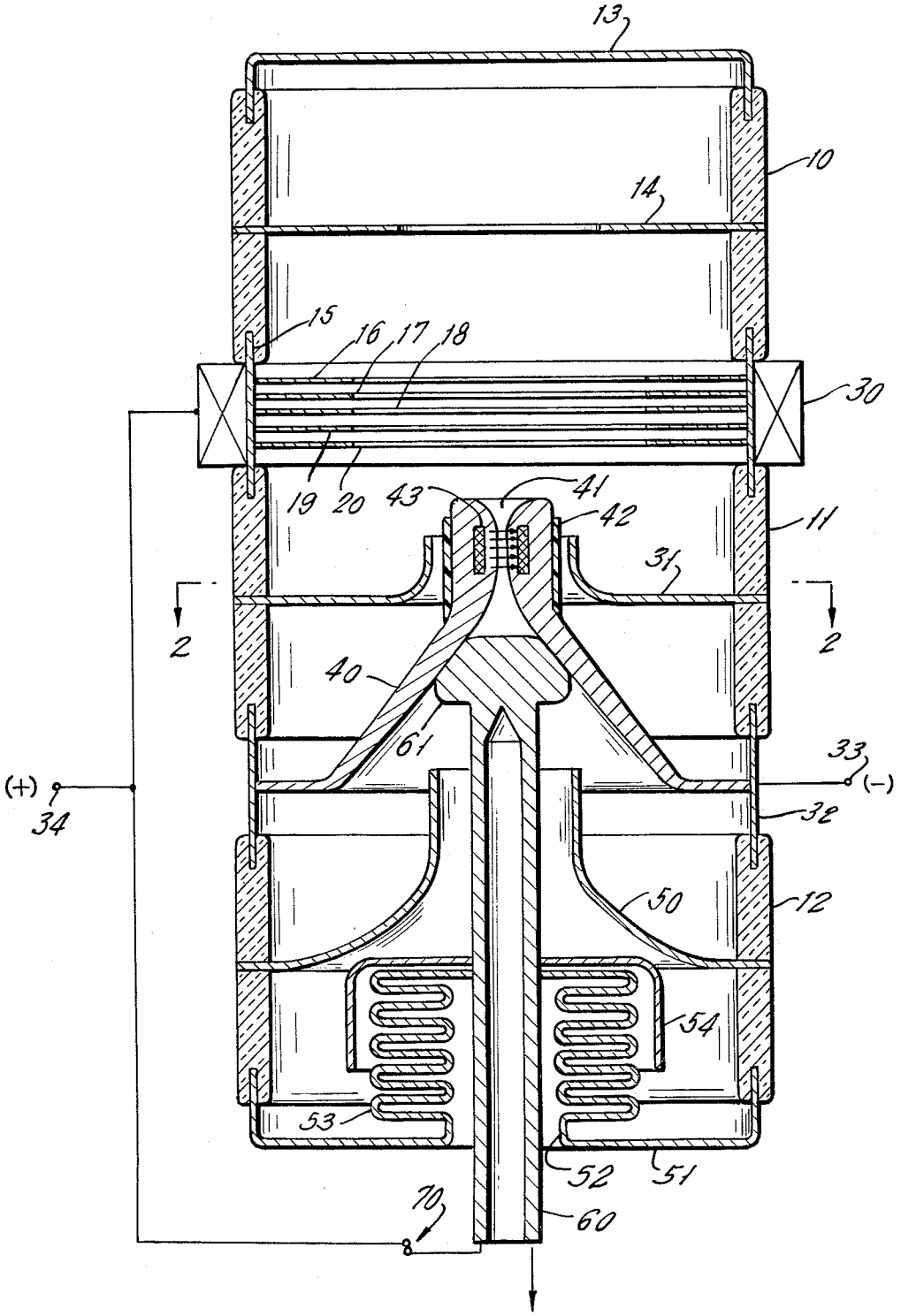
FIG. 1 is a cross-sectional view through the axis of an interrupter structure constructed in accordance with the present invention.
Figure 2:
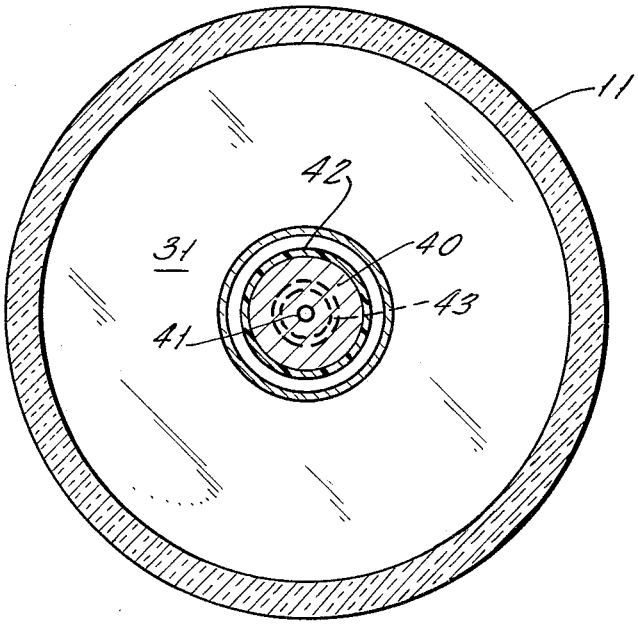
FIG. 2 is a cross-sectional view of FIG. 1 taken across the section lines 2—2 in FIG. 1.

Referring first to FIGS. 1 and 2, there is shown therein a preferred embodiment of the present invention wherein both a vacuum switching device and a magnetically modulatable arc device are contained within the same evacuated housing and use a commonality of components.

The vacuum housing consists of three insulation rings 10, 11 and 12. Ring 10 has a metallic end seal 13 and further contains a baffle shield 14 of conventional construction. Rings 10 and 11 are joined together by a sealed metallic anode ring 15 which contains inwardly projecting metallic plates 16 to 20, wherein the anode plate 15 and plates 16 to 20 are constructed in the manner shown in above-noted copending application Ser. No. 777,479. As further disclosed in that application, an electrical winding 30 surrounds the anode 15.

Ring 11 supports a second baffle shield 31 which is constructed, as shown in FIG. 1, to assist in the control of the electrical field within the container, and ring 11 is connected to ring 12 by the conductive connection ring 32. The conductive connection ring 32 also serves as the negative terminal 33 for the circuit interrupter. Note that the anode ring 15 is connected to the positive device terminal 34. A fault-current limiting resistor 35 is connected between terminals 33 and 34 and in parallel with the vacuum switching device and magnetically modulatable arc.

Conductive ring 32 also serves to support a generally conically shaped cathode member 40, which member has a central axial opening 41 therethrough facing toward the anode ring 15. Conical cathode member 40 is surrounded by an insulation sleeve 42 and may also contain embedded therein a suitable permanent magnet 43 which is permanently magnetized to produce a magnetic field transversely across the opening gap 41, as indicated by the arrows.

The lower insulation support ring 12 then carries a third shield 50 and receives at its bottom a bottom cap 51 which has opening 52 therein. A suitable bellows seal 53 is connected as shown to the bottom cap 51 and the bellows seal 53 is covered by a suitable shielding cup 54.

A movable contact rod 60 then passes through opening 52 and is connected to the bellows 53 and enters into the interior of the evacuated container. The upper contact head 61 of contact rod 60 engages the interior conical surface of cathode 40, which surface faces away from the anode 15.

A secondary break device 70, which may consist of a pair of contacts or an electrical gap in air, hydrogen or oil, or the like, is then connected to the movable contact rod 60 and to the positive terminal 34.

Figure 3:
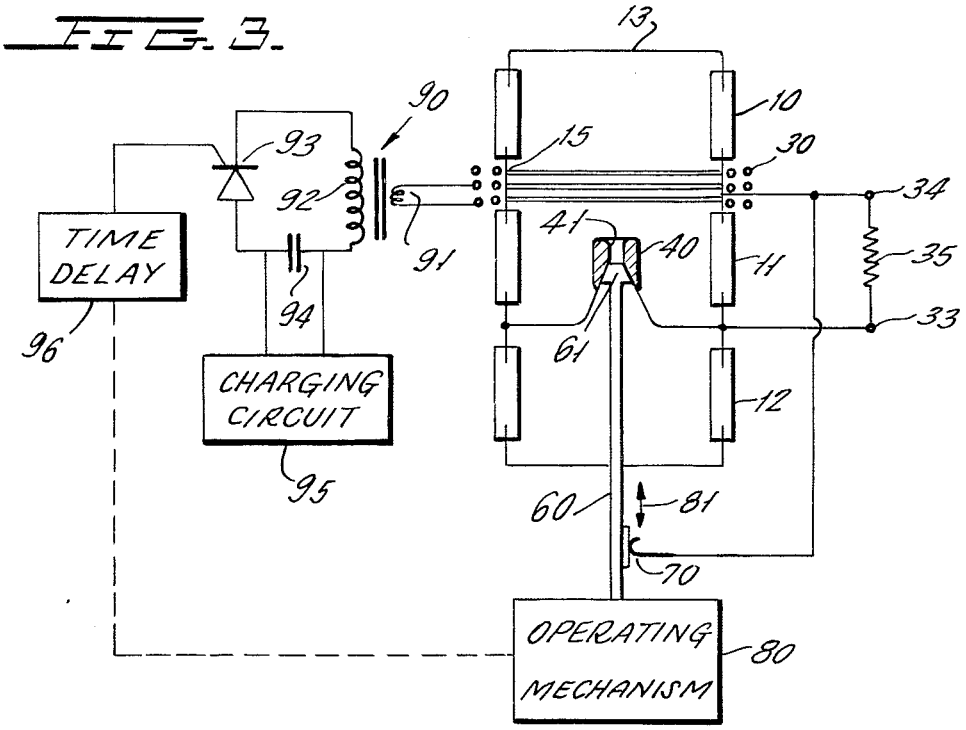
FIG. 3 is a schematic diagram of the interrupter structure of FIGS. 1 and 2 along with a schematically illustrated operating circuit and mechanism.

FIG. 3 schematically illustrates the interrupter of FIGS. 1 and 2, and further schematically illustrates an external operating mechanism 80 which is connected to operating rod 60, and is operable to move the operating rod in the direction of double-ended arrow 81, where the contact head 61 moves into and out of engagement with the rear surface of conical cathode 40.

FIG. 3 further illustrates a control circuit for energizing winding 30 with a high current pulse, which circuit includes a pulse transformer 90 having a secondary winding 91 connected to the winding 30, and a high voltage primary winding 92 connected in series with a controlled rectifier 93 and an energy storage capacitor 94. The energy storage capacitor 94 is normally charged through a suitable charging circuit 95.

A gate electrode of controlled rectifier 93 is then actuated by a signal derived from the operating mechanism 80 but delayed by a suitable time delay circuit 96 so that the controlled rectifier 93 is fired only after contact 61 has separated from cathode 40 and the arc drawn between the two has been extinguished and transferred to the gap between cathode 30 and anode 15.

The operation of the novel circuit interrupter of FIG. 3, when used as a fault limiter, can now be described. With the interrupter in the closed condition, current flow is normally from terminal 33 to cathode 40, to contact 61, through the secondary break contact 70, to terminal 34.

If a signal is now given to the operating mechanism 80 to open the interrupter, the contact rod 60 is moved downwardly to initiate an arc between contact head 61 and cathode 40. This arc is preferably a high voltage arc through the proper choice of materials for contact 61 and the interior surface of cathode 40. Charge carriers produced by this arc which serves as an ignition arc will move upwardly through the orifice 41 and will initiate an arc between the cathode 40 and the anode 15.

As the contact 61 continues to draw away from the cathode 40 within the evacuated container, this movable contact arc will be extinguished and all current flow will be transferred to the arc between cathode 40 and anode 15 which can burn with an arc voltage of about 40 volts. The mechanical switch consisting of contacts 61 and 40 should open on the rising portion of the first half-wave of fault current. Once the time needed for extinguishing the arc from contact 61 has passed, time delay circuit 96 causes the application of a firing pulse to the gate of controlled rectifier 93 so that capacitor 94 discharges into winding 92 to provide a high current pulse into winding 30 to cause a high magnetic field pulse in the arcing space between cathode 40 and anode 15 which will increase the arc voltage rapidly in order ultimately to extinguish the arc and to transfer all current into resistor 35. As an alternative, a series-excited magnetic field coil can be used with time delay achieved by delayed diffusion of the magnetic field through the anode. Thus, coil 30 of FIGS. 1 and 3 can be connected in series with the vacuum arc.

It should be noted that the secondary break 70 is shown in FIG. 3 as a sliding contact arrangement. This contact may be so arranged that, once the movable contact rod 60 is moved to a point where the contact arc voltage is increasing, the secondary break contact 70 will open to still further increase the effective arc voltage between contact 61 and cathode 40.

Thus, the present invention provides, in a single evacuated container, both a vacuum switch circuit in parallel with a magnetically modulatable vacuum arc device, and the vacuum switch also serves as the igniter circuit for the arc in the magnetically modulatable vacuum arc device.

In the foregoing, the invention has been described in connection with illustrative embodiments thereof. Since variation and modification will be obvious to those skilled in the art, it is preferred that the scope of the disclosure be limited, not by the specific disclosure herein set forth, but only by the appended claims.

The embodiments of the invention in which an exclusive privilege or property is claimed are defined as follows:

1. A circuit interrupter comprising, in combination:

an evacuated housing having an axis;

a ring-shaped anode electrode disposed coaxially with said housing, and a terminal connected to said ring-shaped electrode and accessible externally of said housing;

a cathode electrode disposed within said housing and spaced from and insulated from said anode electrode and being coaxial with said anode electrode, and a terminal connected to said cathode electrode and accessible externally of said housing;

an electrical winding concentrically surrounding said anode electrode for producing a magnetic field in the space between said cathode and anode electrodes to increase the impedance of an arc in said space and to extinguish said arc;

a movable contact disposed within said housing and being relatively movable into and out of engagement with said cathode electrode and operable from regions external of said housing;

and circuit means for connecting said movable contact to said anode electrode when said movable contact engages said cathode electrode, thereby to define a closed circuit between said first and second terminals when said movable contact engages said cathode electrode; said movable contact and cathode electrode being arranged whereby an arc is drawn between said movable contact and said cathode electrode when said movable contact is moved away from said cathode electrode, which arc is rapidly transferred to between said anode and cathode electrodes;

and power supply circuit means for applying current to said electrical winding after said movable contact separates from said cathode electrode.

2. The device of claim 1, wherein said cathode electrode comprises a generally conically shaped hollow member having its apex directed towards said anode electrode; said movable contact engaging said hollow member on the surface thereof facing away from said anode electrode; and a central axial opening in said cathode electrode.

3. The device of claim 1, wherein said anode electrode defines a portion of the wall of said housing.

4. The device of claim 1, which further includes bellows seal means for movably mounting said movable contact relative to said housing.

5. The device of claim 2, which further includes magnet means for producing a magnetic field across said central axis opening in said cathode electrode.

6. The device of claim 2, wherein said anode electrode defines a portion of the wall of said housing.

7. The device of claim 2, which further includes bellows seal means for movably mounting said movable contact relative to said housing.

8. A fault current limiter and circuit interrupter comprising, in combination:

a vacuum housing having a pair of externally accessible terminals;

a pair of cooperable load contacts disposed within said vacuum housing and external operating mechanism means connected to said contacts for operating said contacts between an open and a closed position;

a ring-shaped anode electrode and a concentric winding therearound each disposed concentrically with said housing; said ring-shaped anode electrode connected to one of said pair of terminals; said ring-shaped anode electrode and its said concentric winding comprising the anode and winding of a magnetically modulated vacuum arc discharge device; one of said pair of cooperable contacts comprising the cathode electrode of said magnetically modulated vacuum arc discharge device;

whereby the opening of said pair of contacts initiates an arc which transfers from said pair of contacts to between said anode and cathode electrodes and which is magnetically controlled by a magnetic field produced by said winding.

9. The device of claim 8, wherein said cathode electrode comprises a generally conically shaped hollow member having its apex directed toward said anode electrode and serves as one of said pair of contacts; the other of said pair of contacts engaging said hollow member on the surface thereof facing away from said anode electrode; and a central axial opening in said cathode electrode.

* * * * *